US009022241B2

(12) United States Patent
Weissbrod et al.

(10) Patent No.: US 9,022,241 B2
(45) Date of Patent: May 5, 2015

(54) STACKABLE CONTAINER

(75) Inventors: Paul A. Weissbrod, South Euclid, OH (US); Joshua A. Esack, Geneva, OH (US)

(73) Assignee: Lincoln Global, Inc., City of Industry, CA (US)

( * ) Notice: Subject to any disclaimer, the term of this patent is extended or adjusted under 35 U.S.C. 154(b) by 539 days.

(21) Appl. No.: 13/116,692

(22) Filed: May 26, 2011

(65) Prior Publication Data

US 2011/0220530 A1 Sep. 15, 2011

(51) Int. Cl.

| | |
|---|---|
| ***A45C 11/24*** | (2006.01) |
| ***A45F 5/02*** | (2006.01) |
| ***B65D 21/02*** | (2006.01) |
| ***B65D 85/26*** | (2006.01) |
| ***B65D 25/22*** | (2006.01) |
| *B65D 6/24* | (2006.01) |

(52) U.S. Cl.

CPC ..... *A45C 11/24* (2013.01); *B65D 11/1873* (2013.01); *A45F 5/021* (2013.01); *B65D 21/0202* (2013.01); *B65D 85/26* (2013.01); *B65D 25/22* (2013.01)

(58) Field of Classification Search

CPC .... B65D 5/4208; B65D 25/22; B65D 51/242; B65D 11/1873; B65D 11/1866; B65D 85/26

USPC ..... 220/751, 756, 758, 776, 4.03, 4.26; 248/318

See application file for complete search history.

(56) References Cited

U.S. PATENT DOCUMENTS

| | | | | |
|---|---|---|---|---|
| 1,682,179 | A * | 8/1928 | Krembs | 206/443 |
| 2,352,685 | A | 7/1944 | Podgurski | |
| 2,456,481 | A | 12/1948 | Ballantyne et al. | |
| 2,706,574 | A | 4/1955 | Clement | |
| 3,045,962 | A * | 7/1962 | Paulus | 248/220.21 |
| 3,219,400 | A | 11/1965 | Bergquist | |
| 3,556,453 | A * | 1/1971 | Hall | 248/311.2 |
| 3,732,986 | A | 5/1973 | Bush | |
| 3,807,679 | A * | 4/1974 | Burke et al. | 248/690 |
| 3,933,268 | A | 1/1976 | Buske | |
| 4,266,690 | A | 5/1981 | Holmes et al. | |

(Continued)

FOREIGN PATENT DOCUMENTS

| | | | |
|---|---|---|---|
| DE | 23 65 193 | A1 | 7/1975 |
| DE | 202008007805 | U1 | 10/2008 |

(Continued)

OTHER PUBLICATIONS

International Search Report, Sep. 24, 2012.

(Continued)

*Primary Examiner* — Stephen Castellano

(74) *Attorney, Agent, or Firm* — Hahn, Loeser & Parks, LLP

(57) ABSTRACT

A container for storing welding electrodes includes a container body and a container cap constructed via thermoplastic injection molding. The container is constructed with walls that define an interior region and complementary upper and lower surfaces. When multiple containers are stacked together, the upper surface of one container engages the lower surface of an adjacent container thereby restraining lateral movement between the containers. However, the configuration of the upper and lower surfaces allows for longitudinal movement between the containers.

6 Claims, 15 Drawing Sheets

(56) References Cited

U.S. PATENT DOCUMENTS

| | | | | |
|---|---|---|---|---|
| 4,293,072 | A | 10/1981 | Hill et al. | |
| 4,306,662 | A * | 12/1981 | Sciortino et al. | 215/395 |
| 4,426,001 | A | 1/1984 | Stahl et al. | |
| 4,504,723 | A | 3/1985 | Gobran et al. | |
| 4,534,466 | A | 8/1985 | Wood | |
| 4,593,816 | A | 6/1986 | Langenbeck | |
| 4,624,383 | A | 11/1986 | Moore | |
| 4,884,739 | A | 12/1989 | Nederveld | |
| 4,953,764 | A | 9/1990 | Kovacs | |
| 5,050,755 | A | 9/1991 | Strawder | |
| 5,050,786 | A | 9/1991 | DeMott | |
| 5,116,290 | A | 5/1992 | Ross | |
| 5,167,336 | A | 12/1992 | Lajovic | |
| 5,266,772 | A | 11/1993 | Reed | |
| 5,337,511 | A | 8/1994 | Ashbaugh | |
| 5,425,196 | A | 6/1995 | Schwarze | |
| 5,480,028 | A | 1/1996 | Robinson | |
| 5,593,037 | A | 1/1997 | Ohayon | |
| 5,699,925 | A | 12/1997 | Petruzzi | |
| 6,062,388 | A | 5/2000 | Ohayon | |
| 6,082,541 | A | 7/2000 | Bewick | |
| 6,131,730 | A | 10/2000 | Hsu | |
| 6,343,693 | B1 * | 2/2002 | Finley | 206/338 |
| 6,581,772 | B2 | 6/2003 | Noland | |
| 6,588,612 | B1 | 7/2003 | Dorn et al. | |
| 6,708,824 | B2 | 3/2004 | Sahm, III | |
| 6,880,705 | B2 | 4/2005 | Otting et al. | |
| 6,889,838 | B2 | 5/2005 | Meier et al. | |
| 6,932,228 | B1 | 8/2005 | Darr et al. | |
| 6,948,617 | B2 | 9/2005 | Kanter et al. | |
| 7,204,465 | B2 * | 4/2007 | Cheng | 248/311.2 |
| 7,267,227 | B2 | 9/2007 | Dubois et al. | |
| 7,562,784 | B2 * | 7/2009 | Stevenson | 220/4.26 |
| 7,721,885 | B2 | 5/2010 | Conklin | |
| 7,780,004 | B2 | 8/2010 | Carlozzi et al. | |
| 2004/0173613 | A1 | 9/2004 | Schroeder et al. | |
| 2004/0262483 | A1 | 12/2004 | Hsieh | |
| 2007/0051650 | A1 | 3/2007 | Carlozzi et al. | |
| 2007/0221608 | A1 | 9/2007 | Axe et al. | |
| 2008/0041851 | A1 | 2/2008 | Thrapp | |
| 2008/0067211 | A1 | 3/2008 | Steele et al. | |
| 2008/0083799 | A1 | 4/2008 | Kramer et al. | |
| 2009/0108008 | A1 | 4/2009 | Weissbrod et al. | |
| 2010/0019008 | A1 | 1/2010 | Grundy et al. | |
| 2010/0251672 | A1 * | 10/2010 | Weissbrod | 53/444 |
| 2010/0308096 | A1 | 12/2010 | Carlozzi et al. | |

FOREIGN PATENT DOCUMENTS

| | | | |
|---|---|---|---|
| EP | 2168889 | A1 | 3/2010 |
| ES | 1071152 | U | 1/2010 |
| FR | 2 642 045 | A | 7/1990 |
| JP | 10211009 | A | 8/1998 |
| JP | 2000103464 | | 4/2000 |

OTHER PUBLICATIONS

Hobart, Stick Welding Accessories, http://www.hobartwelders.com/products/accessories/stick; Published Jan. 7, 2011.

Western Safety; Harbor Freight; Welding Rod Keeper; http://www.harborfreight.com/wleding-rod-keeper-46477.html; Published Jan. 7, 2011.

* cited by examiner

FIG. 5
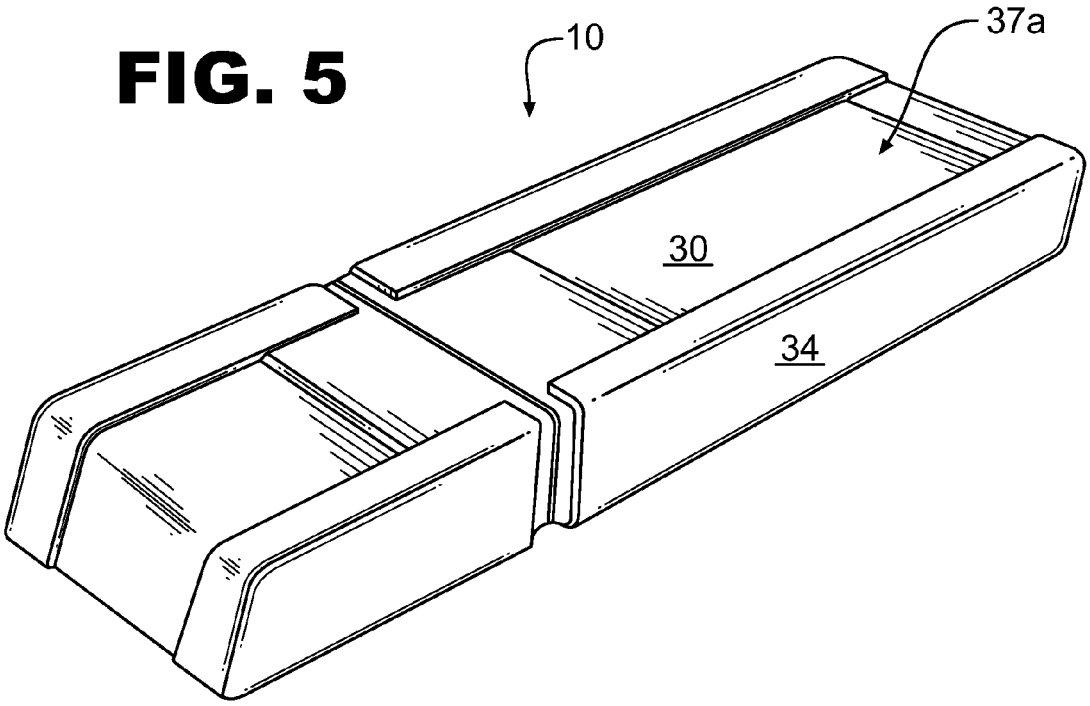
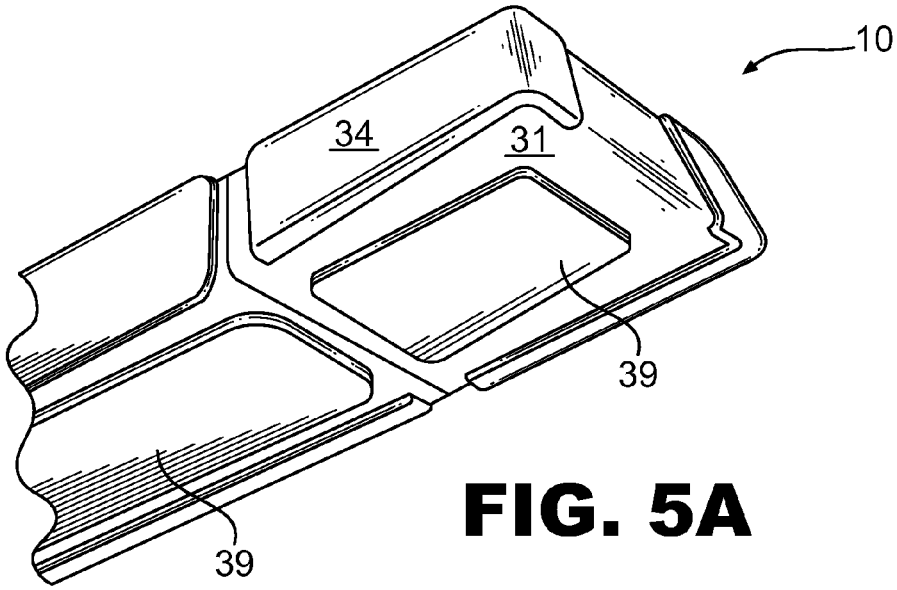
FIG. 5A

STACKABLE CONTAINER

CROSS-REFERENCE TO RELATED APPLICATION

This application is a continuation-in-part of U.S. Pat. application Ser. No. 11/931,899, filed Oct. 31, 2007, now abandoned, the disclosure of which is incorporated by reference in its entirety herein.

TECHNICAL FIELD

The present invention pertains to stackable containers, and more particularly, to stackable containers for packaging welding electrodes.

BACKGROUND OF THE INVENTION

Numerous types of consumable articles are packaged for display and sale to the consumer every day. Some articles are sold in containers arranged in a retail display and categorized by function or use in a particular application. It will be appreciated that the type of article sold may affect the kind of packaging needed to store and effectively display the article. Some articles are bundled together and packaged in rigid containers, which do not conform to the shape of the bundle. As a result, the articles tend to shift within the container when handled. One such type of article pertains to industrial consumables like, for example, welding rods used in a stick welding procedure.

Current packaging of such materials includes containers that are constructed with a generally flat bottom, which allow for movement between containers when stacked together. Consumers frequently pick up the containers looking for information about a particular product needed for their application. When placed back on the shelf or stand, the articles tend to shift within the container often resulting in a stack of offset containers. This leaves the display looking disjointed and unsightly, and reflects negatively on the manufacturer. In many instances, the containers slide and fall from the stack damaging the contents.

Accordingly, a need exists for a generally rigid container than includes means for stacking multiple containers in an orderly fashion while providing easy access to the consumer. The embodiments of the subject invention provide a stackable container that restrains lateral movement between stacked containers but allows for longitudinal movement thereby obviating the aforementioned problems.

BRIEF SUMMARY

In one embodiment of the present invention, a stackable container having an interior region for storing associated welding materials includes a container body having one or more walls that define an open end for receiving the associated welding electrodes, the one or more walls defining first and second distally disposed surfaces that comprise complementary contours for restraining lateral movement while allowing longitudinal movement of a first stackable container with respect to a second substantially similar stackable container when the containers are placed in a stacking relationship.

In one aspect of the embodiments of the subject invention, the container body is generally longitudinal and includes a recess longitudinally fashioned within the first surface, and at least a first protrusion extending from the second distally disposed surface, wherein when the at least a first protrusion of the first stackable container is juxtaposed to the recess of the second stackable container, the first stackable container is restrained from lateral movement with respect to the second stackable container.

In another aspect of the embodiments of the subject invention, the at least a first protrusion includes at least a first ridge longitudinally fashioned along the second distally disposed surface.

In still another aspect of the embodiments of the subject invention, the second distally disposed surface includes a first and at least a second ridge longitudinally fashioned along the second distally disposed surface.

In yet another aspect of the embodiments of the subject invention, the container body is constructed from a moldable polymer.

In another aspect of the embodiments of the subject invention, the stackable container includes a recess that has a characteristic width w, and at least one rib extending from the first surface and spanning the width of the recess.

In even another aspect of the embodiments of the subject invention, the first surface includes first and second generally beveled corner portions, wherein each of the first and second generally beveled corners form an angle A with respect to a transverse axis of the stackable container and wherein the second distally disposed surface comprises third and fourth generally planar beveled portions, wherein each of the third and fourth generally planar corners form an angle A1 with respect to a transverse axis of the stackable container.

In still yet another aspect of the embodiments of the subject invention, the angles A and A1 are substantially equal.

In another embodiment of the subject invention, a stackable package of welding consumables includes an injection molded container body having one or more walls that define an open end and an interior region, the one or more walls defining first and second surfaces that restrain lateral movement while allowing longitudinal movement of a first stackable package with respect to a second substantially similar stackable package when the first and second stackable packages are placed in a stacking relationship, and one or more welding electrodes enclosed within the container body.

In one aspect of the embodiments of the subject invention, the stackable container includes a cap adapted to engage the container body for enclosing the open end of the container body.

In another aspect of the embodiments of the subject invention, the container body has a substantially uniform cross section with respect to a longitudinal axis.

In yet another aspect of the embodiments of the subject invention, the stackable package includes a recess longitudinally fashioned within the first surface, and wherein the second surface is complementary with respect to the first surface for restraining lateral movement of the first stackable package with respect to the second stackable package.

BRIEF DESCRIPTION OF THE DRAWINGS

FIG. 5 is a perspective view of another embodiment of a stackable container according to the embodiments of the subject invention.

FIG. 5*a* is a perspective view of the underside of a stackable container according to the embodiments of the subject invention.

DETAILED DESCRIPTION OF THE INVENTION

Figure 1:
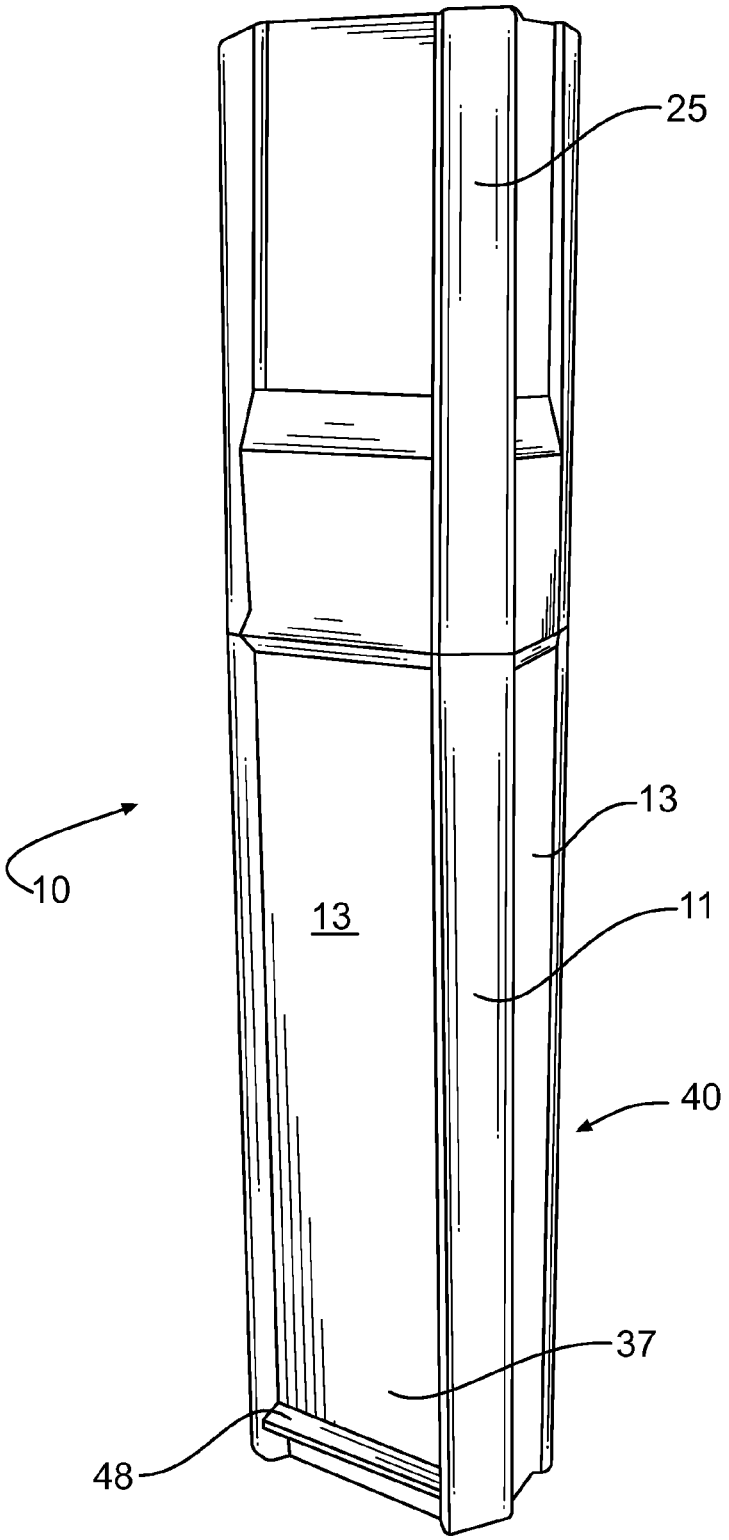
FIG. 1 is a perspective view of a container for packaging articles according to the embodiments of the subject invention.
Figure 2:
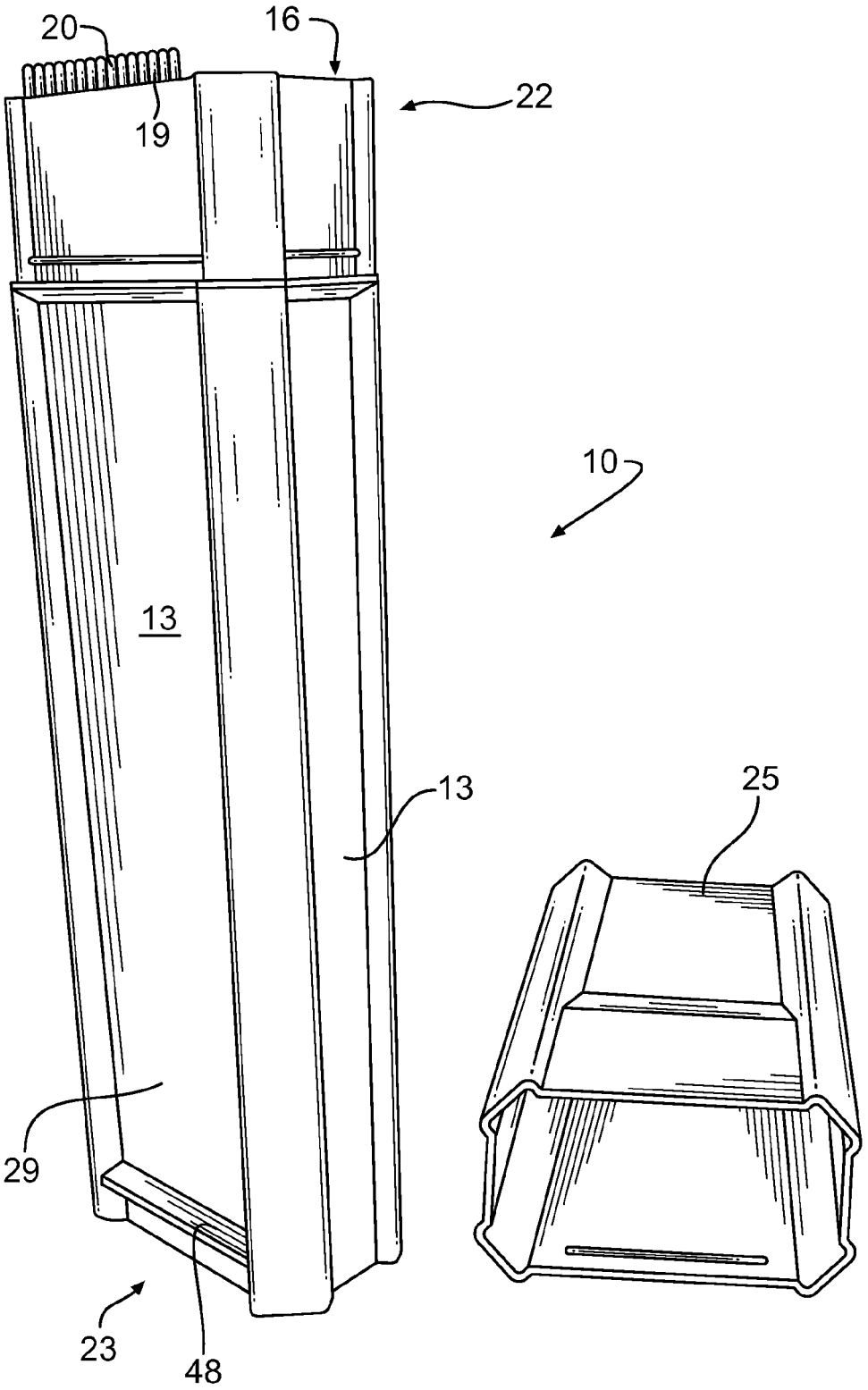
FIG. 2 is a perspective view of a container showing a cap for enclosing articles stored within the container according to the embodiments of the subject invention.

Referring now to the drawings wherein the showings are for purposes of illustrating embodiments of the invention only and not for purposes of limiting the same, FIGS. 1 and 2 show a container 10, for packaging one or more articles. The container 10 may include a plurality of walls 13 that define an interior region 16 for storing the articles. In one embodiment, the container 10 is sized and configured to store a plurality of articles, which by way of example, may be welding electrodes 19. More specifically, the container 10 may be used to store and/or package welding rods 20. As such, the container 10 may be generally longitudinal. However, persons of ordinary skill in the art will readily understand the application of the embodiments of the subject invention to other types of articles. The walls 13 further define first and second ends 22, 23, of which one end, herein illustrated as 22, may be open for receiving the welding electrodes 19. It should be realized that the distal or second end 23 of the container 10 is closed. As it is desirable to preserve the integrity of the welding electrodes 19 by protecting them from ambient conditions until needed for a particular welding application, the container 10 may be a generally rigid container and may further include a cap 25 for enclosing the welding electrodes 19 within the container 10.

Figure 3:
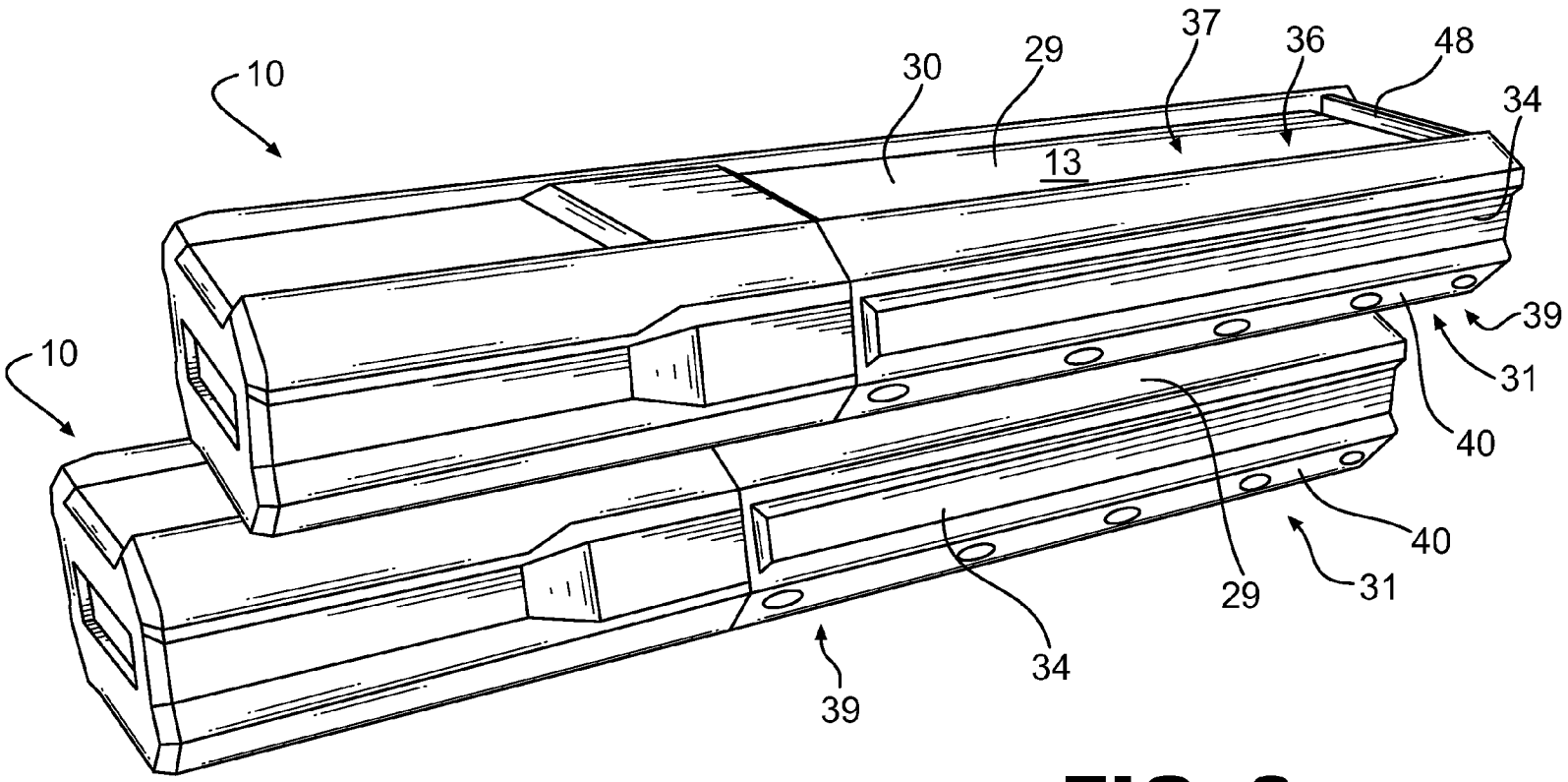
FIG. 3 is a perspective view of multiple substantially similar containers stacked together according to the embodiments of the subject invention.

With continued reference to FIGS. 1 and 2 and now also to FIG. 3, the container 10 may be a stackable container 10. By stackable it is meant that multiple containers 10 may be placed one on top of another wherein alignment is maintained by the configuration of the containers 10. The walls 13 may therefore define an exterior surface 29 having complementary surfaces that comprise the stackable container 10 and function to maintain alignment. In one embodiment, the complementary surfaces are comprised of first and second walls or wall portions 30, 31, which may be top and bottom walls 30, 31. The top and bottom walls 30, 31 may be separated or spaced apart by side walls or side wall portions 34. In an exemplary manner, the container 10 may comprise two generally planar side wall portions 34 thus framing a container 10 that has a generally rectangular cross section. It follows that each of the walls 30, 31 and 34 may be fashioned at substantially right angles. However, it is to be construed that the walls 30, 31 and 34 may be curved, or include curved portions, and may furthermore be oriented at angles other than 90° without departing from the intended scope of coverage of the embodiments of the subject invention.

With continued reference to FIGS. 1 through 3, the exterior surfaces, and in particular the top and bottom walls 30, 31, may be constructed having matching recesses and protrusions respectively. That is to say that the top wall 30 may include a recess 36 configured to receive a protrusion 39 in the bottom wall 31 of an adjacently placed and substantially similar container 10. The recess 36 may be longitudinally formed along the upper surface of the container 10, i.e. the top wall 30. In one embodiment, the recess 36 extends along the entire length of the container 10. Alternative embodiments are contemplated wherein the recess 36 extends along a portion of the upper surface of the container 10. The protrusion 39 described above may be positioned opposite to that of the recess 36 thus facilitating the stacking of one container 10 onto another. The matching configuration of the recess 36 and the protrusion 39 may function to restrain lateral movement between stacked containers 10 while allowing longitudinal movement between the containers 10. This allows the potential buyer to handle the packaged articles, stacked in a retail display for example, without disrupting the orderly arrangement of the containers 10. Accordingly, the top wall 30 includes an upper surface having a recess 36, which may be a channel 37, and the bottom wall 31 includes a lower surface having a protrusion 39 extended therefrom for fitting into the recess 36 of another container 10.

Figure 4:
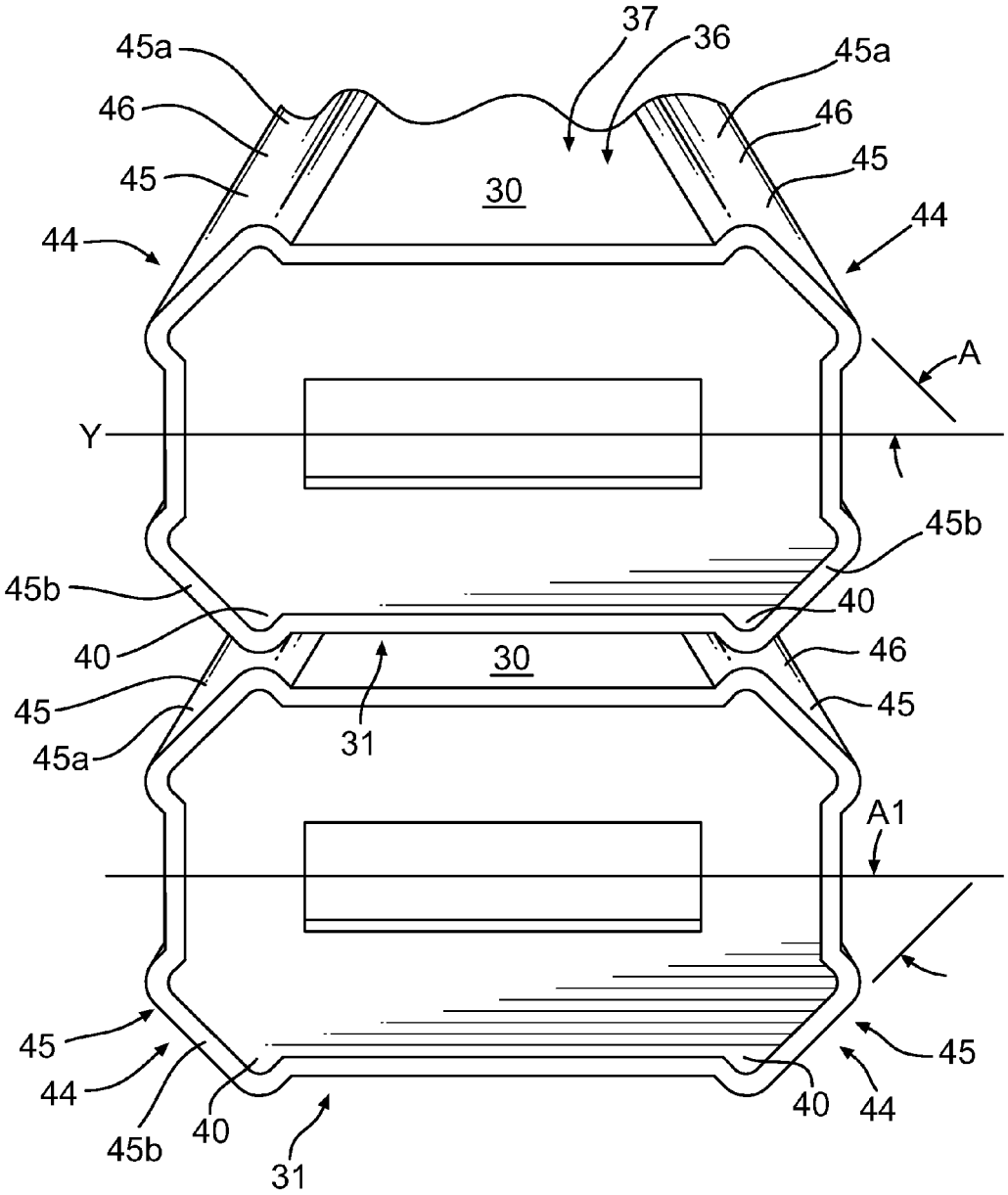
FIG. 4 is an end view of multiple substantially similar containers stacked together according to the embodiments of the subject invention.

With reference now to FIGS. 3 and 4, FIG. 4 depicts one embodiment of the subject invention, which shows an end view of two stacked containers 10. In this embodiment, the recess 36 fashioned in the upper surface of the top wall 30 comprises a channel 37 that extends along the entire length of the container 10 and spans a width of the top wall 30. It is noted that the channel 37 may be fashioned having any width as is appropriate for use with the embodiments of the subject invention. The lower surface of the distal wall 31 correspondingly includes a rail or ridge 40 that extends along the opposite side of the container 10. As two containers 10 are stacked together, the ridge 40 of one container 10 is received within the channel 37 and abuts the extents of the channel 37, which functions as a guide to keep the containers 10 aligned. More specifically, the lower surface may include two rails or ridges 40 spaced apart by a distance that matches the width of the channel 37. It is to be construed that the width of the channel 37 and the distance between the ridges 40 may be set at any length suitable for use with the embodiments of the subject invention. However, it is preferred that the two dimensions are close in magnitude thereby ensuring a close fit between the stacked containers 10.

With continued reference to FIG. 4, in one embodiment the interface 44 of the container walls 30, 31 may include beveled surfaces 45. That is to say that the sides of the container walls 30, 31 terminate in angled edges 46, which may be generally planar in configuration. The beveled surfaces 45 may be fashioned to extend outside the perimeter of walls 30, 31 and 34, the ends of which may form the channel 37 in the upper surface of the top wall 30 and the ridges 40 in the lower surface of the bottom wall 31. It is noted that the width of the beveled surfaces 45*a* adjacent the top wall 30 are shorter than the width of the beveled surfaces 45*b* adjacent the bottom wall 31. Thus, it will be appreciated that the wider beveled surfaces 45*b* narrow the gap between the ridges 40 to a distance sufficient to fit within the channel 37 fashioned in the top wall 30. It is to be construed that any width of beveled surface 45*a*, 45*b* and, in particular, any ratio of widths of the beveled surfaces 45*a*, 45*b* may be chosen with sound engineering judgment. It will be realized by persons of ordinary skill in the art that the angles at which the beveled surfaces 45 are fashioned, when referenced from a transverse container axis Y, may also affect how the ridges 40 engage the channel 37. In the current embodiment, the angles of the beveled surfaces 45*a*, 45*b* with respect to the transverse container axis Y may be 45°. That is to say that the angles of the beveled surfaces 45*a*, 45*b* may be substantially equal. However, it is contemplated in an alternate embodiment that the angle of the beveled surfaces 45*a* may be different than the angle of the beveled surfaces 45*b*. In fact, any angle of the beveled surfaces 45*a*, 45*b* may be chosen with sound engineering judgment as is appropriate for constructing a stackable container 10. While the aforementioned embodiment describes upper and lower surfaces comprised of generally planar contours, it will be understood that curved or other nonlinear surfaces, may also be utilized to comprise the complementary upper and lower surfaces for constructing a stackable container 10.

With reference again to FIGS. 1 and 3, the container 10 may further include a rib 48 fashioned in a cross wise manner spanning the width of the channel 37. The height of the rib 48 may be shorter than the depth of the channel 37. In this manner, the rib 48 functions to help position the ridges 40 of an adjacent container 10 within the channel 37. Without the rib 48, a container 10 stacked onto another container 10 may sit offset with respect to the longitudinal centerline of the container 10. As a result, lateral movement may be restrained in only one direction affording the subsequently stacked container 10 the opportunity to slide off the stack in the opposite direction. Any number of ribs 48 may be incorporated into the upper surface contour at various positions along the length the container. In the current embodiment, a first rib 48 is fashioned at one end of the container 10. At the distal end of the container 10, a second rib 48 may be included that is comprised of a connecting region between the cap 25 and the container body 11. In other words, the overlapping portions of the cap 25 and the container body 11 form a second rib 48 for aligning the stacked containers 10, as will be discussed further in a subsequent paragraph.

Figure 6:
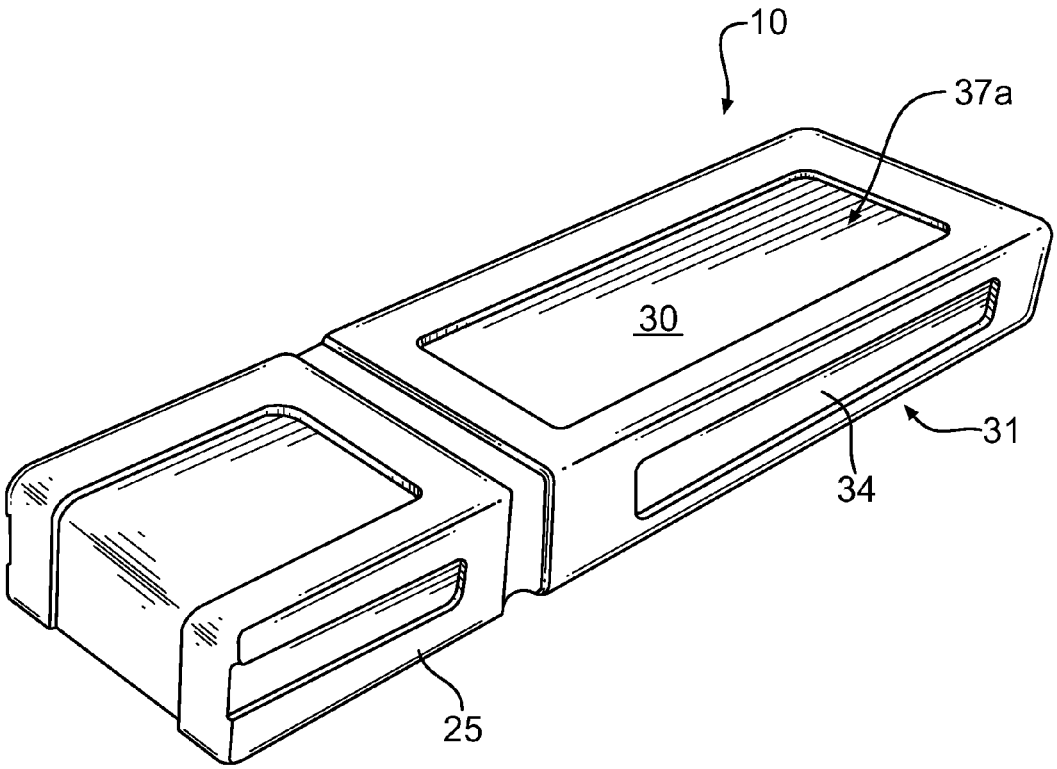
FIG. 6 is a perspective view of another embodiment of a stackable container according to the embodiments of the subject invention.

With reference now to FIGS. 5, 5*a* and 6, another embodiment of the subject invention will now be discussed. Similar to the previous embodiments, the container 10 may be fashioned having a generally rectangular cross section. However, the corners of the container 10 of the current embodiment do not terminate in beveled surfaces 45*a*, 45*b*. Rather, the top and bottom walls 30, 31 extend directly from the side walls 34 at substantially right angles. To facilitate longitudinal movement between stacked containers 10, the upper surface of the top wall 30 may include a channel 37*a* like that of the previous embodiments. However, by way of contrast to the previous embodiment, the protrusion 39 may be fashioned to extend directly and perpendicularly from the bottom wall 31, having a width slightly less than the width of the channel 37*a*. Accordingly, when one container 10 is stacked onto another, the channel 37 of the first container 10 receives the protrusion 39*a* of the second container. The sides of the channel 37 therefore function to constrain the stacked container 10 by restricting lateral movement of the protrusion 39*a* but allowing for longitudinal movement there between.

The container 10 may be constructed using moldable materials such as a thermoplastic polymer. In an exemplary manner, the container 10 may be constructed using polypropylene, polyethylene, and/or rubber. However, any type of material, thermoplastic, thermoset or otherwise, may be utilized to construct the containers 10 of the embodiments of the subject invention. The container 10 may be formed using an injection molding process. In this process, a mold, typically fashioned from two matching halves, is placed in a press having platens that close to force the mold halves together. The mold is manufactured with a cavity that, when closed, define the shape of the container 10. In one embodiment, mold cores are used to determine the shape of the interior of the container 10. Polymer material is then melted in a barrel and then injected into the mold cavity. A cooling cycle is subsequently initiated, after which the molded container 10 is ejected from the mold. It is noted here that other processes may also be used to construct the container 10 including but not limited to blow molding.

Figure 7:
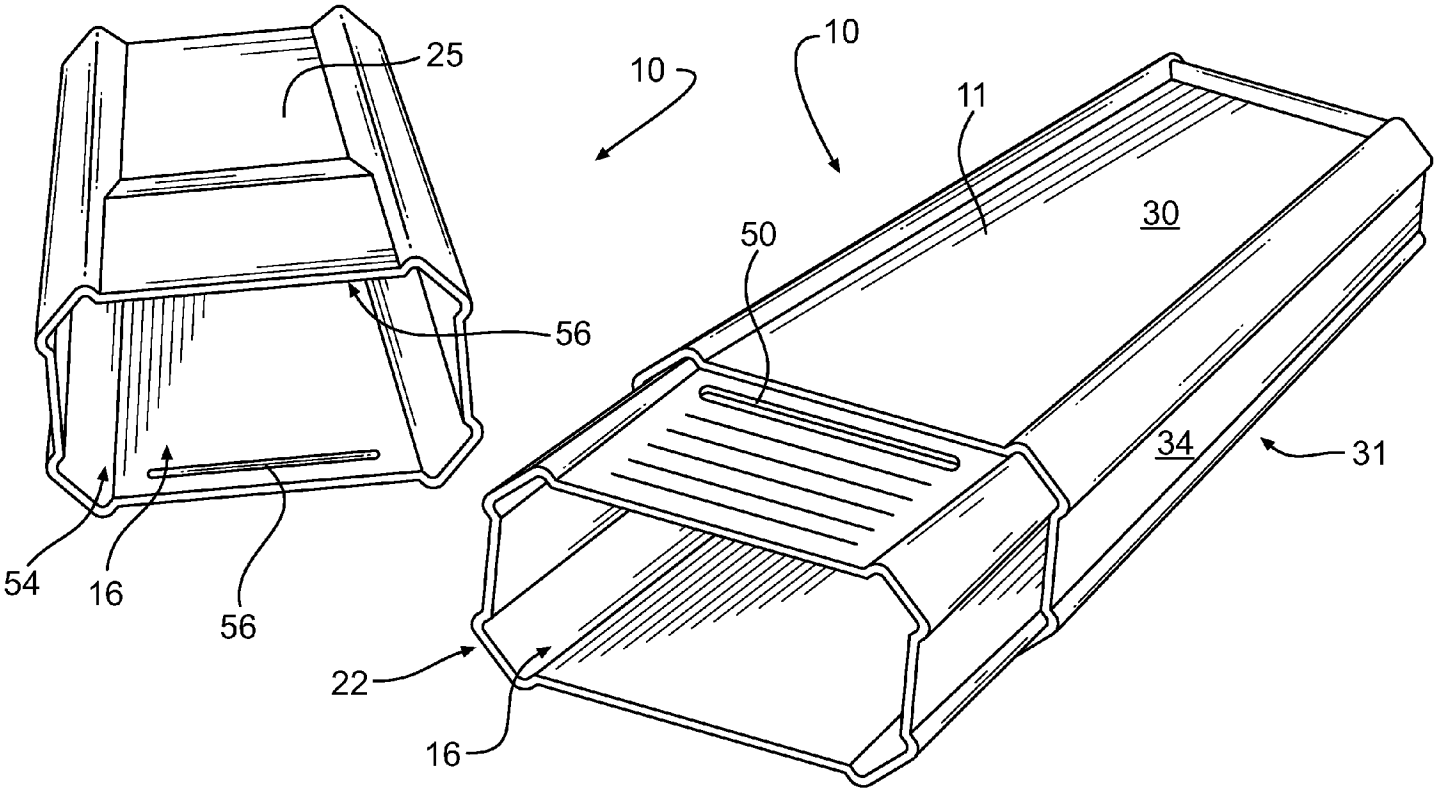
FIG. 7 is a perspective view of a container showing a cap for enclosing articles stored within the container according to the embodiments of the subject invention.

With reference again to FIG. 2 and now to FIG. 7, as previously mentioned, the container 10 may include a cap 25 for enclosing the welding electrodes 19 within the container 10. As such, the container 10 may comprise a container body, illustrated generally at 11, for receiving the welding electrodes 19, and a container cap 25 for enclosing the container 10. The cap 25 may be constructed in a separate but similar process to that of the container body 11, as mentioned above. In one embodiment, the cap 25 may have a similar configuration to that of the container body 11. That is to say that the cap 25 may include one or more walls 30, 31 and 34 that define an interior region 16, which may correspond to the interior region 16 of the container body 11. In this manner, welding electrodes 19 stored within the container 10 are uniformly supported at both ends to minimize any damage that may result from being transported between locations. The length of the container body 11 may be proportionate to the length of the welding electrodes 19 stored therein. More specifically, the container body 11 may have a length slightly shorter than the length of the welding electrodes 19 so that, when the cap 25 is removed, only the end is exposed thus minimizing the potential for damage to the electrode 19. The cap 25 may be distinctively shorter than the container body 11. In one embodiment, the cap 25 may be just long enough to cover the exposed portion of the welding rod without leaving excess room within the container 10, as excess room in the container 10 may damage the welding electrodes 19 during shipment. However, it is to be construed that any length of cap 25 and any length of container body 11 may be chosen as is appropriate for use with the embodiments of the subject invention.

With continued reference to FIG. 7, the cap 25 may be constructed to interlock with the container body 11. In one embodiment, the cap 25 may be constructed having an open mouth 54 similar to that of the open end 22 of the container body 11. The cap 25 may further include a lip 56 fashioned on the inside of the mouth 54, which is designed to engage a rim 50 fashioned on the exterior of the container body 11 near the open end 22. To enclose the open end 22 of the container body 11, the mouth 54 may be constructed having a slightly larger circumference so that the cap 25 fits over the open end 22 of the container body 11. In this manner, as the cap 25 is positioned onto the container body 11, the lip 56 and/or the rim 50 resiliently deform thereby snapping into engagement and enclosing the welding electrodes 19 within the container 10. Similarly, pulling the cap 25 from the container body 11 will disengage the lip 56 and rim 50. It is noted here that any thickness of the walls near the mouth 54 of the cap 25 and the open end 22 of the container body 11 may be chosen as is appropriate for use with the embodiments of the subject invention.

Figure 8:
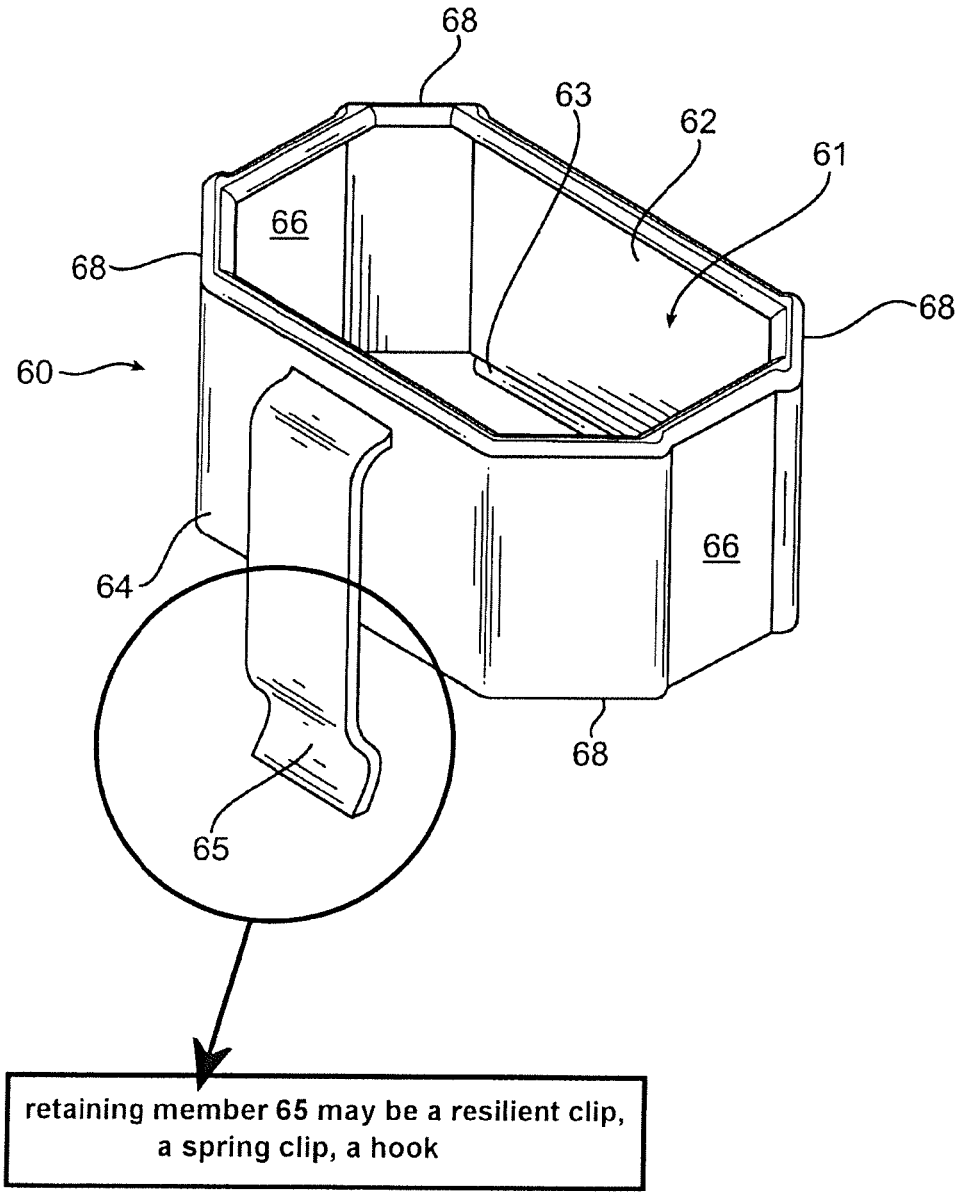
FIG. 8 is a perspective view of an embodiment of an adapter for a container for packaging articles according to the embodiments of the subject invention.
Figure 8A:
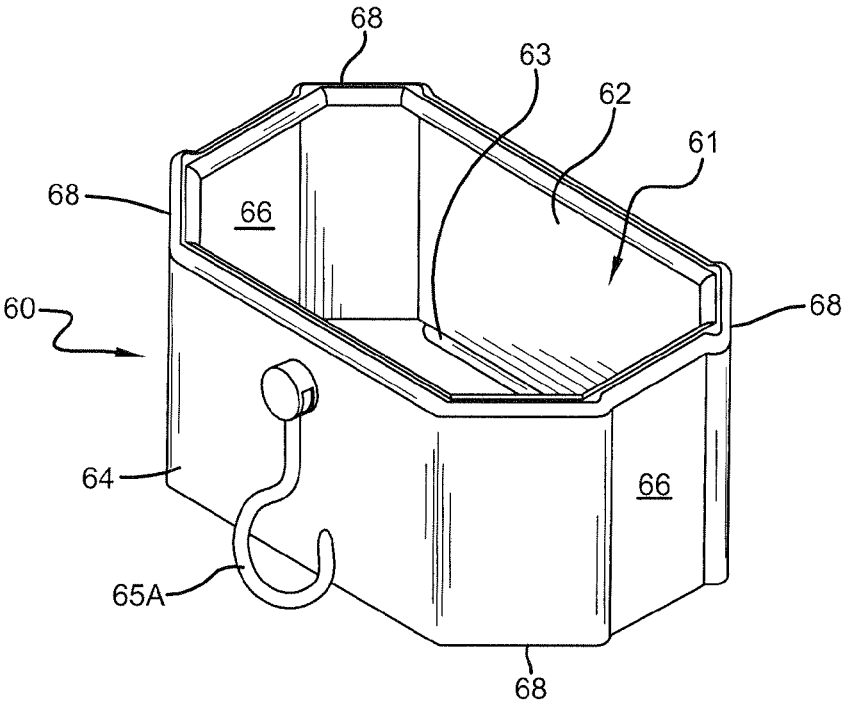
FIG. 8A is a perspective view of an embodiment of a adapter for a container for packing articles according to the embodiments of the subject invention.
Figure 8B:
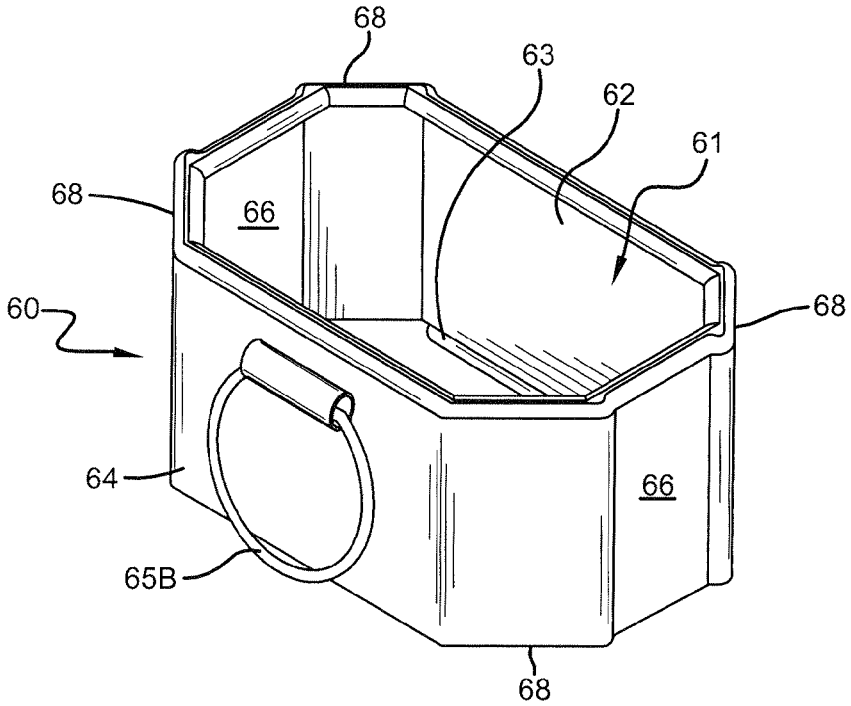
FIG. 8B is a perspective view of an embodiment of an adapter for a container for packing articles according to the embodiments of the invention.
Figure 9:
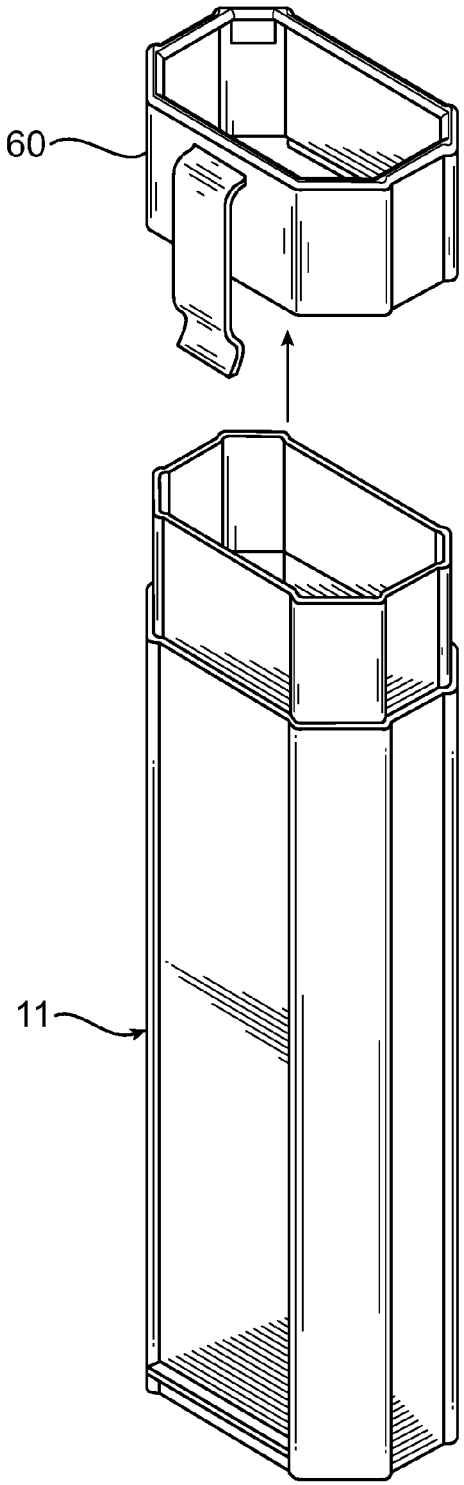
FIG. 9 is an exploded perspective view of the adapter shown in FIG. 8 in conjunction with a container for packaging articles according to the embodiments of the subject invention.
Figure 10:
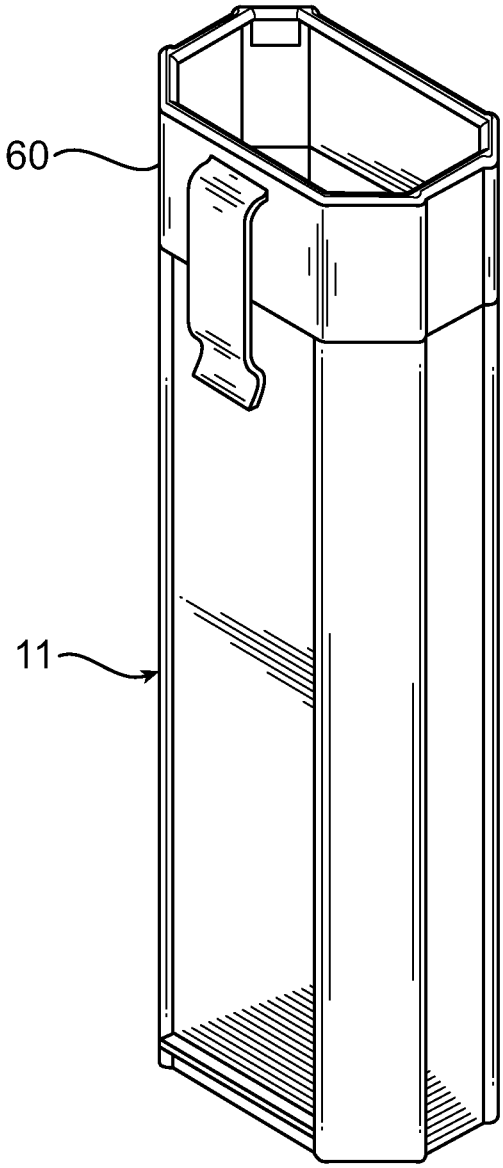
FIG. 10 is a perspective view of the adapter shown in FIG. 8 engaged with a container for packaging articles according to the embodiments of the subject invention.
Figure 11:
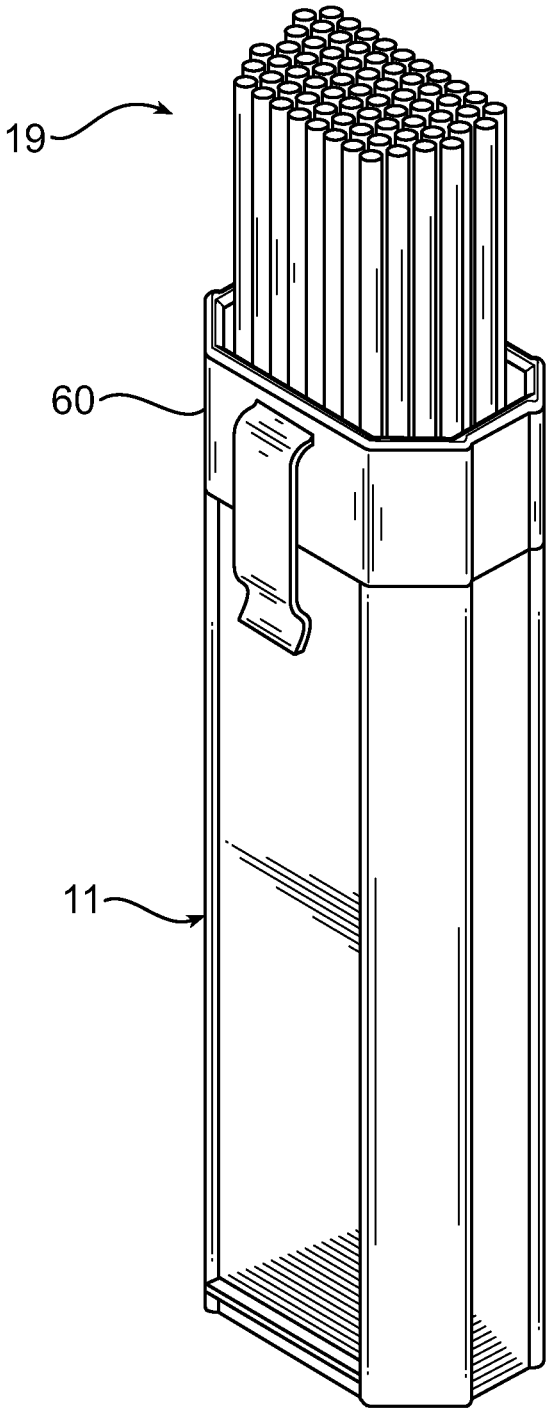
FIG. 11 is a perspective view of the adapter and container for packaging articles as shown in FIG. 10 including articles stored in the container and passing through the adapter according to the embodiments of the subject invention.

Turning now to FIGS. 8-11, an adapter 60 is additionally provided for use in conjunction with the container 10 in order to provide an improved device for carrying elongated objects, such as welding electrodes or rods 19, during welding operations. The adapter 60 includes a passageway or aperture 61 defined by a plurality of walls 62, 64, and 66, and the aperture is dimensioned similarly to the open end 22 of the container body 11. As shown in FIG. 8, the adapter 60 may be a polygon, and more specifically, the adapter 60 may have an eight-sided, or octagonal, perimeter.

In one embodiment, the adapter comprises a front wall 62 which is parallel to and spaced apart from a back wall 64, and a retaining member 65 extends from the back wall. The retaining member 65 may be a resilient clip, a spring clip, a hook, or the like. In the embodiment shown in FIG. 8, the retaining member 65 is formed as a unitary element of the adapter 60. In other words, the retaining member 65 may be molded during the formation of the adapter 60 and the adapter 60 is therefore monolithic, including the retention means 65.

Figure 12:
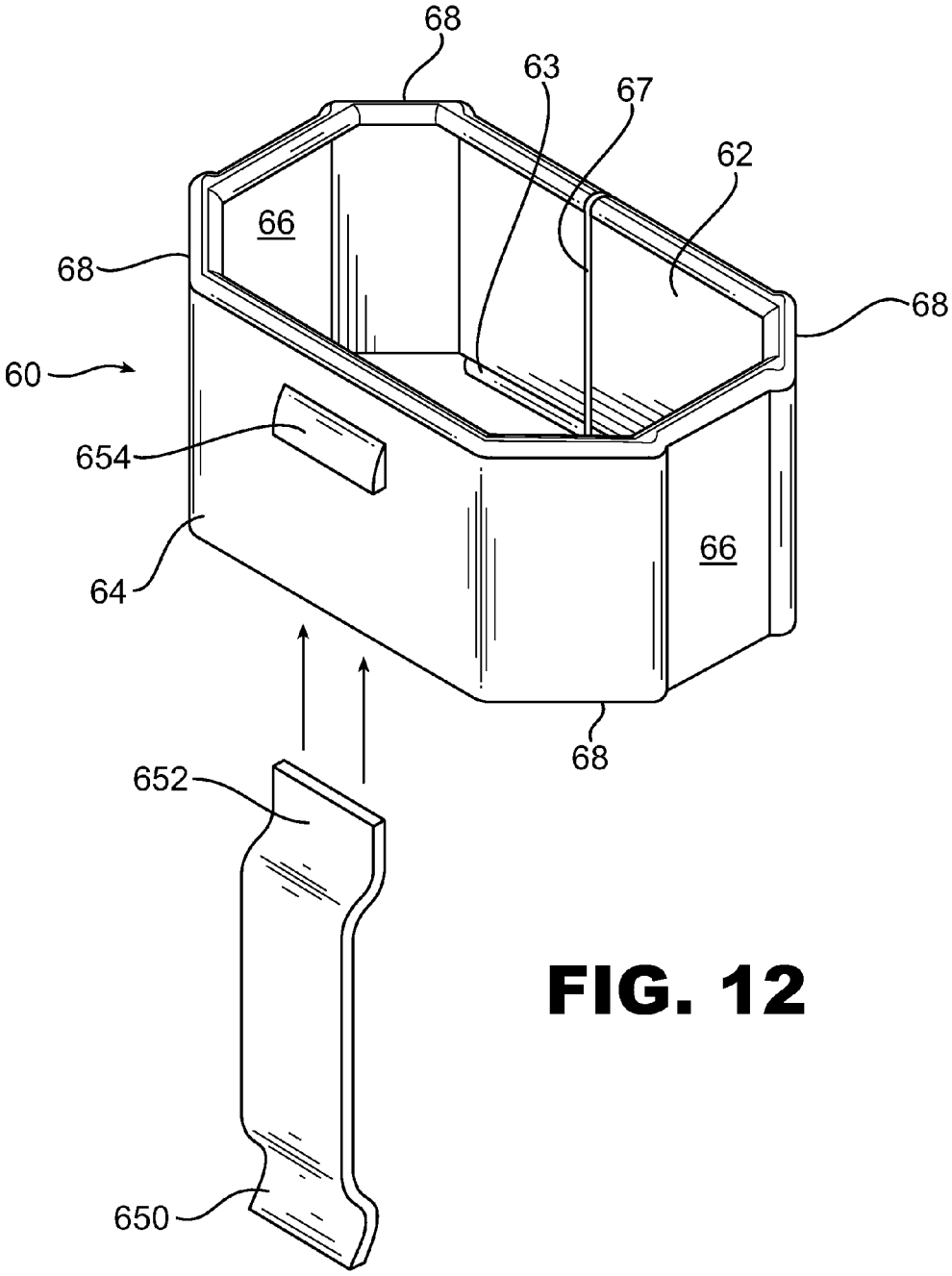
FIG. 12 is a perspective view of a further embodiment of an adapter for a container for packaging articles according to the embodiments of the subject invention.

Alternatively, as shown in FIG. 12, the retaining member 650 may be formed separately from the body of the adapter and subsequently affixed to or into the back wall 64. For example, the retaining member 650 may include a tab or tongue 652 insertable into a slot or recess 654 in the back wall 64 and secured or retained therein by teeth, adhesive, or other methods known by those of skill in the art. As certain materials from which the retaining member 650 may be formed may be subject to strain by repeated stresses during use which may result in decreased retention capabilities, the retaining member may be temporarily affixed to the adapter 60 so that it may be removed from the adapter and replaced by another retaining member. Furthermore, a user may unintentionally plastically deform the retaining member 650 beyond its elastic limit, whereby its retention or holding capabilities may be diminished. Accordingly, it may be desirable to remove and replace the retaining member 650 with another retaining member.

Still further, the adapter 60 includes pair of spaced apart side walls 66 which are perpendicular to the front wall 62 and back wall 64, with angled walls 68 extending between the front, back, and side walls. As such, the axial cross-sectional of the adapter 60 corresponds to, or is similar to, the axial cross-section of the container body 11 and open end 22. It follows that axial cross-section of the adapter 60 has walls 62, 64, 66 arranged in the same manner as the walls and surfaces of the open end 22 of the container body 11, although the adapter walls are dimensioned to be slightly larger than the features of the open end. The adapter 60 is configured in a manner similar to that of the cap 25, i.e., the adapter has a passageway or aperture 61 defined by the walls 62, 64, and 66 which is dimensioned similarly to the open end 22 of the container body 11. As in the case of the cap 25, the adapter 60 includes a lip 63 fashioned on the inside of the passageway 61, where the lip is configured to engage the rim 50 fashioned on the exterior of the container body 11 near the open end 22.

To surround and engage or envelope the open end 22, the passageway 61 is configured to have a slightly larger perimeter than the open end 22. Accordingly, the adapter 60 fits over the open end 22 of the container body 11. In one embodiment, as the adapter 60 is positioned onto the container body 11, the lip 63 and/or the rim 50 resiliently deform, thereby snapping or springing into engagement. Accordingly, the lip 63 and rim 50 may be said to form a detent fit. Alternately, the lip 63 and rim 50 may be secured in an interference fit or snap engagement. Similarly, the adapter 60 is disengaged from the container body 11 by pulling the adapter 60 from the container body 11, whereby the lip 63 and/or rim 50 resiliently deform and pass past each other in a manner similar during the process of engaging the adapter 60 with the container body 11.

Figure 13:
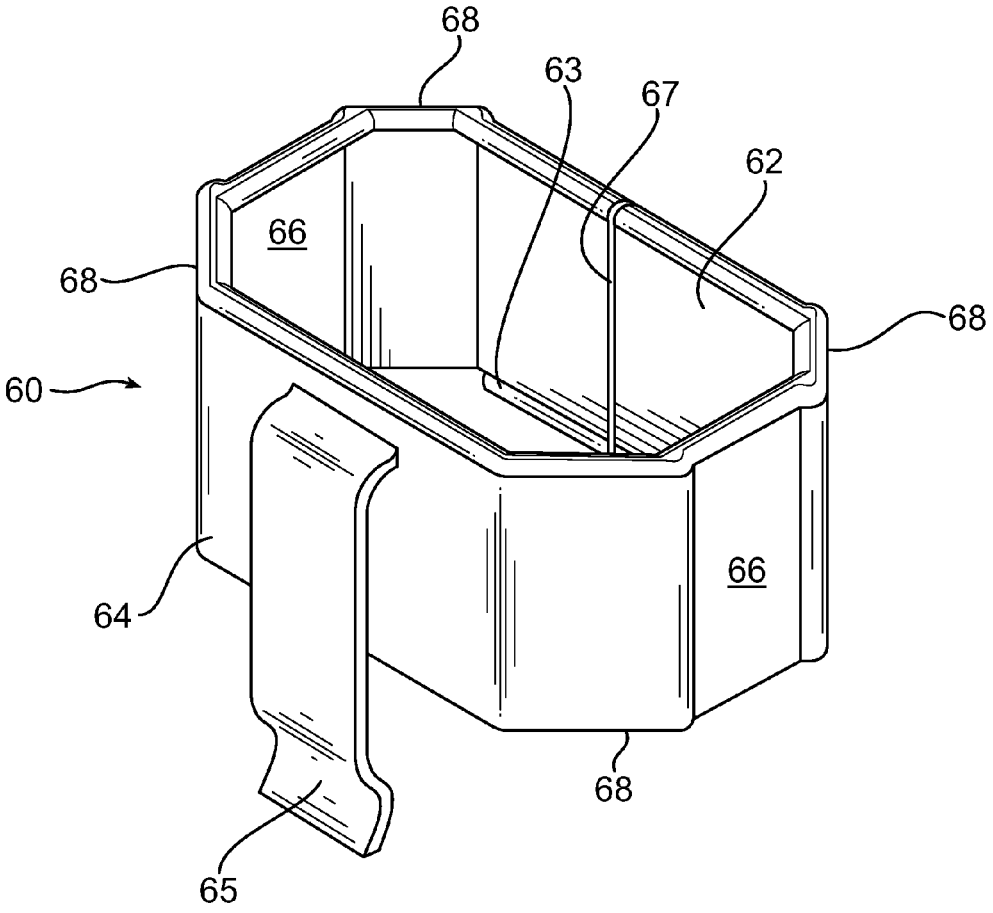
FIG. 13 is a perspective view of a further embodiment of an adapter for a container for packaging articles according to the embodiments of the subject invention.
Figure 14:
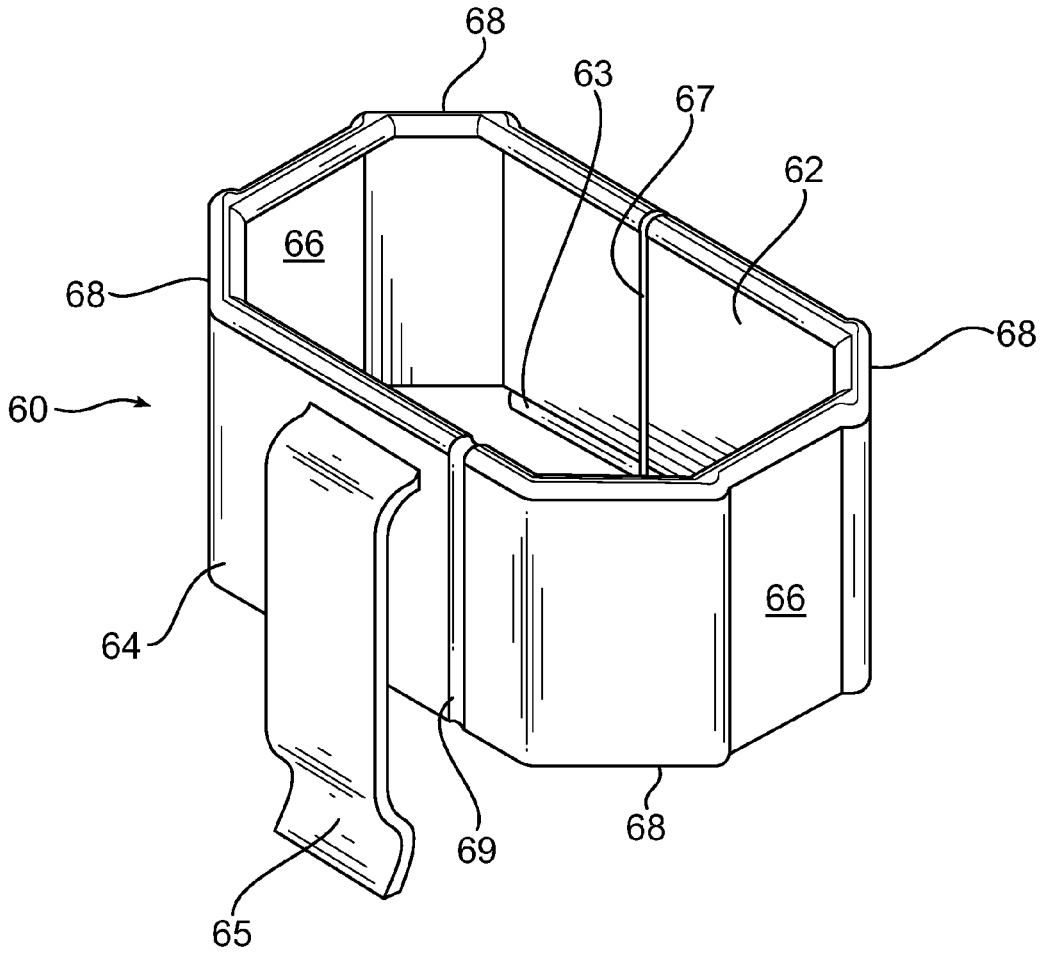
FIG. 14 is a perspective view of another embodiment of an adapter for a container for packaging articles according to the embodiments of the subject invention.

In a further embodiment shown in FIG. 13, a gap or void 67 may be formed in the front wall 62 parallel to the longitudinal axis of the container body 11. In one embodiment, the gap 67 extends through the entire height of the front wall 62, although it is also contemplated that the gap may extend less than the entire height. The configuration shown in FIG. 13 permits the adapter 60 to be relatively more easily deformed as it is engaged with and disengaged from the container body 11. In such a case, the back wall 64 may be resiliently deformable, such that it flexes during engagement and disengagement of the adapter 60 with the container body 11, but returns to its static, unflexed state when engaged or disengaged. Alternatively or additionally, as shown in FIG. 14, the back wall 64 may include at least one living hinge 69, that is, the back wall 64 may be molded to included multiple solid sections connected by a thin, flexible web of material oriented parallel to the longitudinal axis of the container body 11. While the embodiments involving resiliently deformable and/or hinged wall describe such embodiments with respect to the back wall 64, it is envisioned that such features may be incorporated into any of walls 62, 64, 66, and/or 68 so as to enable a user to engage and disengage the adapter 60 from the container body 11. It is noted that any thickness of the walls near the passageway 61 of the adapter 60 and the open end 22 of the container body 11 are contemplated, provided that such thickness permits engagement and disengagement of the adapter in conjunction with the container body.

When a user desires to begin welding, the cap 25 is removed from the container body 11, and the adapter 60 is engaged with the container body 11 as described above. The bottom or second end 23 of the container body 11 may be configured such that cap 25 may be retained on the second end 23 while the adapter 60 is engaged with the container body 11. The user then places the retention means 65 over his belt, waistband, pocket or similar article of clothing, by clipping, sliding, or some other means of engagement. A welding electrode 19 is then removed from the container 10 and placed in an electrode holder. As the first electrode is consumed by the welding process, a second electrode is removed from the container 10 which is conveniently located on the user's person, thereby reducing the time between consuming an electrode and resuming the welding process with a new electrode. Once the user is finished welding, the adapter 60 may be removed from the open end 22 and the cap 25 may be replaced on the open end. For convenience, the adapter 60 may then be placed on the second end 23 so as to minimize the opportunity for misplacing or losing the adapter 60.

The adapter 60 may be constructed of the same or similar materials as those used in manufacture of the container body 11, which may included moldable materials such as a thermoplastic or thermoset polymers. For example, the adapter 60 may be constructed using polypropylene, polyethylene, and/or thermoplastic elastomers, including rubber. In certain embodiments, it may be desirable to form the adapter 60 from a resiliently deformable metal, for example aluminum or the like. As indicated previously, the retaining member 65 may be molded as a unitary portion of the adapter 60. Alternatively, the retaining member 65 may be formed by a separate manufacturing process from a moldable plastic, a metal, or other suitable material and then subsequently affixed to the adapter 60.

In one case, the adapter 60 is formed using an injection molding process. In this process, a mold, typically fashioned from two matching halves, is placed in a press having platens that close to force the mold halves together. The mold is manufactured with a cavity that, when closed, define the shape of the adapter 60. In one embodiment, mold cores are used to determine the shape of the interior of the adapter 60. Polymer material is then melted in a barrel and then injected into the mold cavity. A cooling cycle is subsequently initiated, after which the molded adapter 60 is ejected from the mold. It is noted here that other processes may also be used to construct the adapter 60 including, without limitation, blow molding and stamping.

The invention has been described herein with reference to the preferred embodiment. Obviously, modifications and alterations will occur to others upon a reading and understanding of this specification. It is intended to include all such modifications and alterations insofar as they come within the scope of the appended claims or the equivalence thereof.

What is claimed is:

1. A stackable container having an interior region for storing associated elongate articles, comprising:

a container body having two pairs of opposed interconnected walls and a container floor, said combination of walls and floor defining a container body top open end for receiving the associated articles and an opposed container body bottom closed end, the pairs of opposed interconnected walls defining first and second distally disposed surfaces that comprise complementary contours for restraining lateral movement while allowing longitudinal movement of a first stackable container with respect to a second substantially similar stackable container when the stackable containers are placed in a stacking relationship, said container body further comprising at least one rim positioned normal to a longitudinal axis of said container body and spaced a distance below said container body top open end, said container body further comprising a circumferentially extending stop ledge spaced a distance below said at least one rim; and an insertable adapter for said container body, said adapter insertable over said container body top open end;

said insertable adapter having two pairs of opposed interconnected walls open at opposed ends, said insertable adapter having at least one inwardly protruding lip for engagement with said at least one elongated rim when said inserted adaptor is inserted onto said container body open end; and said adapter also insertable onto said container body closed end for storage when not in use; and said adapter further comprising a means for retention to a user, said means affixed to said adapter.

2. The stackable container as defined in claim 1, wherein the means for retention is selected from the group consisting of a resilient clip, a spring clip, a hook, and a loop.

3. The stackable container as defined in claim 1, wherein the means for retention is formed as a unitary element of the adapter.

4. A stackable container having an interior region for storing associated elongate articles, comprising:

a container body having two pairs of opposed interconnected walls and a container floor, said combination of walls and floor defining a container body top open end for receiving the associated articles, the pairs of opposed interconnected walls defining first and second distally disposed surfaces that comprise complementary contours for restraining lateral movement while allowing longitudinal movement of a first stackable container with respect to a second substantially similar stackable container when the stackable containers are placed in a stacking relationship, said container body further comprising at least one rim positioned normal to a longitudinal axis of said container body and spaced a distance below said container body top open end, said container body further comprising a circumferentially extending stop ledge spaced a distance below said at least one rim; and an insertable adapter for said container body, said adapter insertable over said container body top open end, said insertable adapter having two pairs of opposed interconnected walls, said adapter having an open top and an open bottom and having at least one lip positioned adjacent said open bottom end and normal to a longitudinal axis of said adapter, said at least one lip engaging with said at least one rim in said container body when said adaptor is inserted onto said container body; and wherein said adapter is also insertable onto said container body closed end for storage when not in use; and said adapter further comprising a means for retention to a user, said means affixed to said adapter.

5. The stackable container as defined in claim 4, wherein the means for retention is selected from the group consisting of a resilient clip, a spring clip, a hook, and a loop.

6. The stackable container as defined in claim 4, wherein the means for retention is formed as a unitary element of the adapter.

* * * * *